US009187976B2

(12) United States Patent
He et al.

(10) Patent No.: US 9,187,976 B2
(45) Date of Patent: Nov. 17, 2015

(54) APPARATUS AND METHODS FOR RELEASING DRILLING RIG AND BLOWOUT PREVENTER (BOP) PRIOR TO CEMENT BONDING

(71) Applicant: Vetco Gray Inc., Houston, TX (US)

(72) Inventors: Henry He, Edmonton Alberta (CA); Behrooz Movaffagh, Edmonton Alberta (CA); Huahui Wang, Edmonton Alberta (CA)

(73) Assignee: Vetco Gray Inc., Houston, TX (US)

( * ) Notice: Subject to any disclaimer, the term of this patent is extended or adjusted under 35 U.S.C. 154(b) by 342 days.

(21) Appl. No.: 13/679,709

(22) Filed: Nov. 16, 2012

(65) Prior Publication Data

US 2014/0138086 A1 May 22, 2014

(51) Int. Cl.

| | |
|---|---|
| ***E21B 33/05*** | (2006.01) |
| ***E21B 33/14*** | (2006.01) |
| ***E21B 33/13*** | (2006.01) |
| ***E21B 43/26*** | (2006.01) |
| ***E21B 33/03*** | (2006.01) |
| ***E21B 33/038*** | (2006.01) |
| ***E21B 33/04*** | (2006.01) |

(52) U.S. Cl.

CPC ..... *E21B 33/13* (2013.01); *E21B 33/03* (2013.01); *E21B 33/038* (2013.01); *E21B 33/04* (2013.01); *E21B 43/261* (2013.01)

(58) Field of Classification Search

USPC ..... 166/75.11, 75.18, 90.1, 285, 177.4, 166/75.13

See application file for complete search history.

(56) References Cited

U.S. PATENT DOCUMENTS

| | | | | |
|---|---|---|---|---|
| 4,862,426 | A | 8/1989 | Cassity | |
| 6,571,877 | B1 * | 6/2003 | Van Bilderbeek | 166/339 |
| 6,734,805 | B2 | 5/2004 | Johnson | |
| 7,513,308 | B2 | 4/2009 | Hose et al. | |
| 7,762,338 | B2 | 7/2010 | Fenton | |
| 2005/0082066 | A1 * | 4/2005 | McGuire et al. | 166/379 |
| 2005/0211442 | A1 * | 9/2005 | McGuire et al. | 166/379 |
| 2007/0107910 | A1 | 5/2007 | McGuire et al. | |
| 2009/0032241 | A1 * | 2/2009 | Allen et al. | 166/72 |
| 2009/0107685 | A1 | 4/2009 | Cain et al. | |
| 2009/0212969 | A1 | 8/2009 | Voss | |
| 2009/0236144 | A1 * | 9/2009 | Todd et al. | 175/5 |
| 2011/0083854 | A1 | 4/2011 | Jennings | |

(Continued)

OTHER PUBLICATIONS

Related U.S. Appl. No. 13/239,926, filed Sep. 22, 2011, titled "Method and System for Performing an Electrically Operated Function with a Running Tool in a Subsea Wellhead".

(Continued)

*Primary Examiner* — Kenneth L Thompson

(74) *Attorney, Agent, or Firm* — Bracewell & Giuliani LLP

(57) ABSTRACT

Apparatus and methods for managing cementing operations are provided. An example method includes connecting a cementing adapter atop a casing head itself positioned atop a surface casing landed within a conductor pipe, connecting a drilling adapter atop the cementing adapter, connecting a blowout preventer to the drilling adapter, and drilling for and running production casing. The method also includes positioning a casing hanger at least partially within a bore of the cementing adapter to be immobilized therein to retain back pressure of cement within an annulus located between the production casing and the surface casing, cementing the production casing within the surface casing, and removing the drilling adapter and blowout preventer after running the cement, but typically prior to cement bonding.

15 Claims, 5 Drawing Sheets

(56) References Cited

U.S. PATENT DOCUMENTS

2011/0278005 A1* 11/2011 Nguyen ..... 166/285
2012/0223839 A1 9/2012 Kobata

OTHER PUBLICATIONS

PCT Search Report and Written Opinion issued May 14, 2014 in connection with corresponding PCT Patent Application No. PCT/US2013/069666.

* cited by examiner

APPARATUS AND METHODS FOR RELEASING DRILLING RIG AND BLOWOUT PREVENTER (BOP) PRIOR TO CEMENT BONDING

BACKGROUND OF THE INVENTION

1. Field of the Invention

This invention relates to drilling apparatus and methods, in general, and drilling apparatus and methods for managing the cementing operations, including early component removal.

2. Description of the Related Art

According to the conventional methodology/techniques, production casing such as, for example, 9⅝ inch production casing, is cemented through utilization of a diverter and/or blowout preventer (BOP). Specifically, the diverter and/or BOP provides the cement back pressure until the cement is bonded. This generally results in the drilling rig having to wait and/or remain idle during the bonding process. That is, if the drilling diverter is used to provide the cement back pressure, the drilling diverter cannot be released by the drilling rig until after substantial bonding has occurred. If the BOP is utilized, the drilling rig must remain adjacent the well to provide BOP control until the cement is bonded and the BOP can be removed.

It has therefore been recognized that according to conventional techniques, the drilling diverter and/or BOP cannot be released before the cement is bonded. As such, the drilling rig generally cannot be re-tasked until cement bonding is complete, resulting in substantial drilling rig non-utilization. In order to reduce drilling rig time, a mandrel-type casing hanger has been employed. Such methodology, however, is a very high cost and requires substantial additional components, complicating cementing operations.

SUMMARY OF THE INVENTION

Accordingly, recognized by the inventors is the need for an apparatus and methods which provide for early release of the drilling diverter and/or BOP, if employed, and retasking the drilling rig prior to the cement being substantially bonded. Also recognized is the need for an apparatus and methods which allow for such release of the drilling diverter and/or BOP immediately after deployment of the cement. Further recognized is the need for an apparatus and methods that reduce drilling rig waiting time and reduce drilling rig idle time as a result of waiting for cement bonding.

In view of the foregoing, various embodiments of the present invention advantageously provide apparatus and methods which allow the drilling diverter and/or BOP to be released before the cement is bonded, thereby allowing the drilling rig to be re-tasked immediately after deployment of the cement, but before the cement is bonded. Various embodiments of the apparatus and methods provide a means/methodology to release the drilling diverter/BOP immediately after deployment of the cement. Various embodiments of the apparatus and methods can reduce drilling rig waiting time and reduce drilling rig idle time as a result of waiting for cement bonding.

More specifically, an example of an embodiment of a method of managing cementing operations to provide for early release/retasking of a drilling rig, blowout preventer, and/or drilling adapter, can include connecting a casing head atop a surface casing landed within a conductor pipe, connecting a cementing adapter atop the casing head with a quick connection, connecting a drilling adapter atop the cementing adapter with a quick connection, connecting a blowout preventer to the drilling adapter, drilling for production casing, and running the production casing. The method also includes positioning a casing hanger at least partially within a bore of the cementing adapter to be immobilized therein with the casing hanger circumscribing outer surface portions of the production casing. The casing hanger is positioned and otherwise configured to retain back pressure of cement within an annulus located between the production casing and the surface casing to thereby provide for removal of the drilling adapter and blowout preventer prior to the bonding of the cement. The method correspondingly also includes cementing the production casing within the surface casing, whereby the cement is injected into the annulus and at least a portion of the cement is returned through a return channel extending through the casing head. According to an aspect, the casing hanger is a casing slips hanger landed atop the casing head, and the cementing adapter includes a lock on member configured to engage a shoulder on the casing hanger to immobilize the casing hanger in contact with the casing head.

According to an embodiment whereby a drilling rig is tasked to run the production casing, the method can also include removing the drilling adapter after performing the step of cementing, removing the blowout preventer (if employed) after performing the step of cementing, and re-tasking the drilling rig prior to performing the step of cementing. According to another embodiment, the method includes removing the drilling adapter prior to substantial bonding of the cement, removing the blowout preventer prior to substantial bonding of the cement, and re-tasking the drilling rig prior to substantial bonding of the cement. Both embodiments can include removing the cementing adapter and casing hanger for next use after substantial bonding of the cement.

An example of an embodiment of an apparatus for managing cementing operations to provide for early retasking of a drilling rig, blowout preventer, and/or drilling adapter, can include a casing head connected to a surface casing landed within a conductor pipe, a cementing adapter including a quick connection to connect to the casing head, a drilling adapter at least initially positioned atop the cementing adapter, optionally, a blowout preventer (when utilized), production casing, an annulus formed between the production casing and the surface casing and in fluid communication with the cement return channel of the casing head, and a casing hanger positioned at least partially within a bore of the cementing adapter, immobilized therein, and circumscribing outer surface portions of the production casing. The casing hanger is positioned and/or otherwise configured to retain back pressure of cement within the annulus to thereby provide for removal of the drilling adapter prior to bonding of the cement. According to an aspect, the casing hanger is a casing slips hanger positioned atop the casing head, and the cementing adapter includes a lock on member configured to engage a shoulder on the casing hanger to immobilize the casing hanger in contact with the casing head. According to an aspect, the drilling adapter and/or blowout preventer is configured to be removed prior to or immediately after substantial cement bonding.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Figure 1:
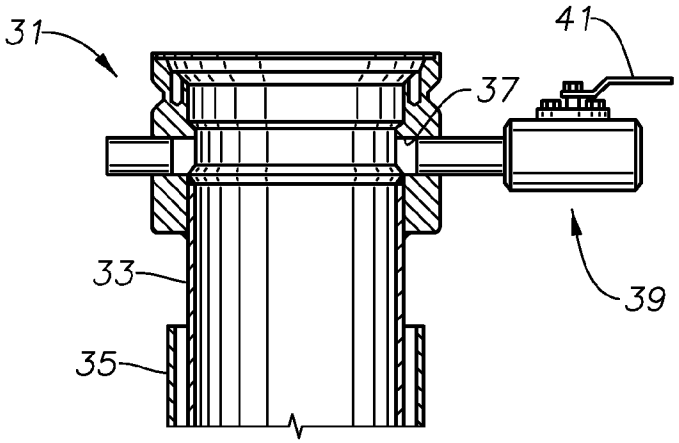
FIG. 1 is a perspective view of the casing head illustrating installation of the casing head as part of a process for assembling wellhead equipment to manage cementing operations according to an embodiment of the present invention.

Various embodiments of the present invention include a casing head having a cement return and a quick connection on the top, a cementing adapter having a quick connection on both the top and bottom, a drilling adapter with a quick disconnect on the bottom, and a removable casing slips hanger. Various embodiments of the present invention provide a casing head for connecting to surface casing (e.g., 13⅜ inch case), which includes at least one cement diversion conduit extending therethrough. Various embodiments of the present invention also provide a drilling adapter with quick connection on the bottom having, e.g., having a metal-to-metal seal, which requires only approximately 30 minutes or less to install. Various embodiments of the present invention provide a casing slips hanger which can be run through the BOP or wrapped around production casing (e.g., 9⅝ inch production case) after running the production casing. According to one or more embodiments, potential drilling rig and BOP time savings of up to 48 hours or more can be achieved. According to one or more embodiments, cement back pressure can be achieved without utilization of a BOP or in-place drilling diverter. According to one or more embodiments, the production casing is automatically centralized via the enhanced casing slips hanger. One or more embodiments provide torque for a mandrel hanger through the landing sub. One or more embodiments allow for verification of an environmental pack off Referring to FIG. 1, according to an exemplary method and apparatus 30, the casing head 31 is landed upon and typically welded to a surface casing 33 (e.g., 13⅜ inch casing in the exemplary embodiment) which is generally positioned with a conductor casing 35 (e.g., 16 inch casing in the exemplary embodiment). The casing head 31 has one or more lateral boresadapted to receive a pipe connection of a corresponding one or more cement return valves 39 also having a bore extending therethrough. At least one of the one or more lateral bores individually or collectively with a corresponding bore extending through the pipe connection form cement channel 37 in the casing head 31. The valve can be of various types known to those of ordinary skill in the art. According to the illustrated embodiment, the valve includes a handle 41 operable by ROV (not shown). Also according to the illustrated embodiment, the upper portion of the casing head 31 is configured to receive a cementing adapter 51 (FIG. 2) having a quick disconnect configuration (e.g., 18 inches in the exemplary embodiment).

Figure 2:
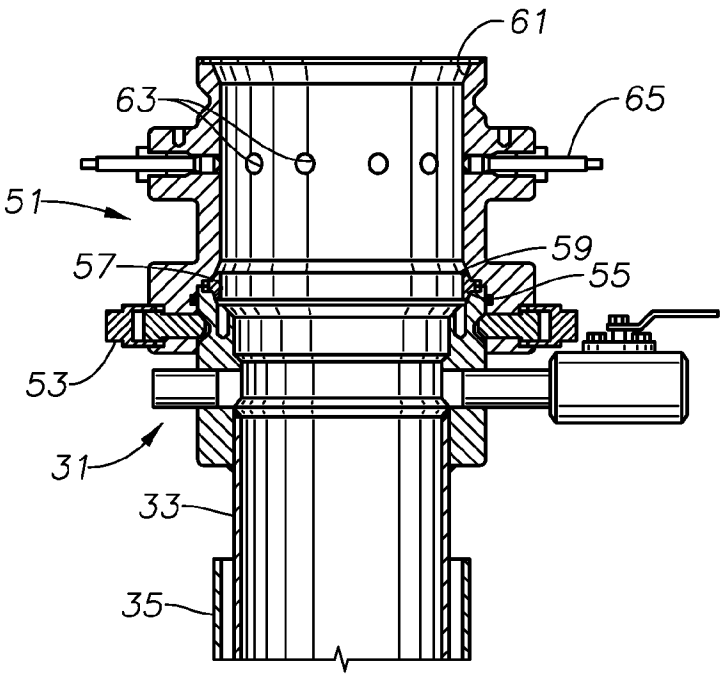
FIG. 2 is a perspective view of a cementing adapter landed upon the casing head of FIG. 1 according to an embodiment of the present invention.

Referring to FIG. 2, the cementing adapter 51 is landed upon the casing head 31, and in the illustrated embodiment, a set of set screws 53 are tightened to secure the cementing adapter 51 atop the casing head 31. A metal-to-metal seal 55 such as, for example, a Greylock-type seal is located within matching tapered rims 57, 59, along the top of the casing head 31 and the bottom of the cementing adapter 51, respectively. Other types of seals for providing a quick connection are, however, within the scope of the present invention. A similar tapered rim 61 is located on the upper portion of the cementing adapter 51. The cementing adapter 51 also includes a set of apertures 63 and a corresponding set of retaining pins/lock screws 65 as will be described in more detail later.

Figure 3:
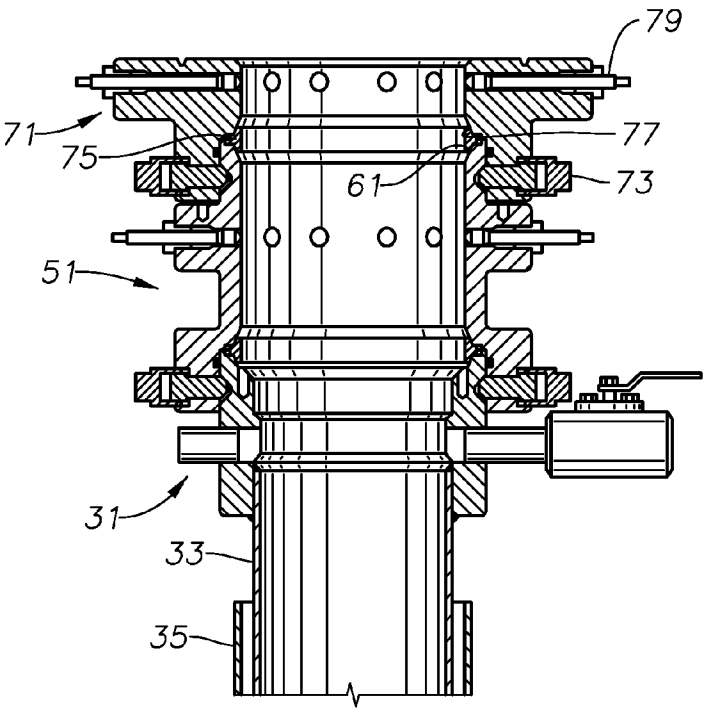
FIG. 3 is a perspective view of a drilling adapter landed upon the cementing adapter of FIG. 2 according to an embodiment of the present invention.

Referring to FIG. 3, a drilling adapter 71 is landed upon the cementing adapter 51, and in the illustrated embodiment, the drilling adapter 51 carries a set of set screws 73 which are tightened to secure the drilling adapter atop the cementing adapter 51 in a quick disconnect connection. A metal-do-metal seal 75 such as, for example, a Greylock-type seal is located within matching tapered rims 61, 77, along a top of the cementing adapter 51 and the bottom of the drilling adapter 71, respectively. As above, other types of seals for providing a quick connection are, however, within the scope of the present invention. The drilling adapter 71 also includes a set of retaining pins/lock screws 79 as will be described in more detail later.

Figure 4:
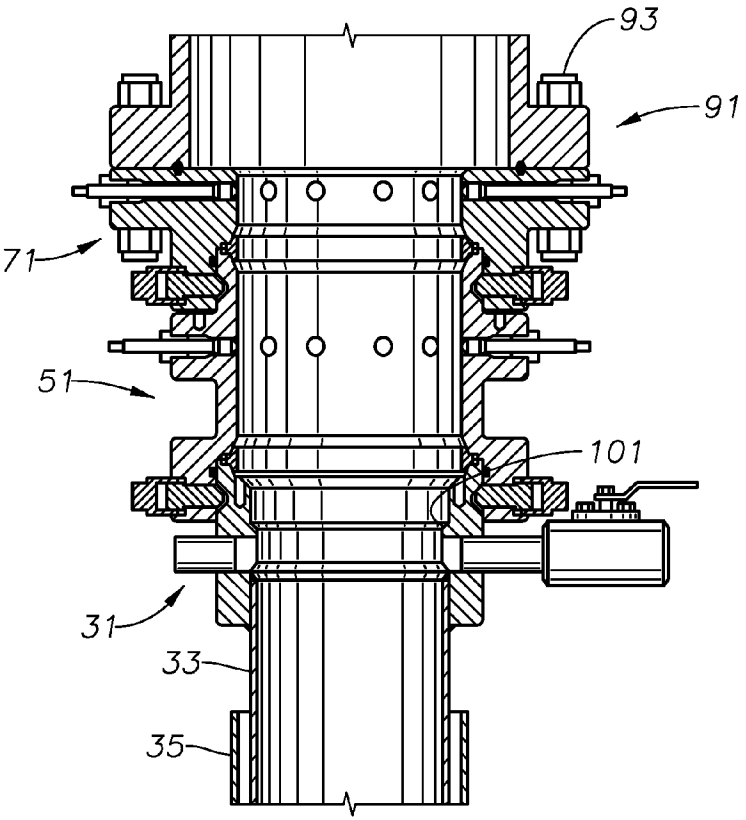
FIG. 4 is a perspective view of a portion of a blowout preventer connected atop the drilling adapter of FIG. 3 according to an embodiment of the present invention.

Referring to FIG. 4, in embodiments where a blowout preventer (BOP) 91 and accompanying rig (not shown), the blowout preventer 91 is landed upon and fastened to an upper surface of the drilling adapter 71 via a set of fasteners 93.

Regardless of whether or not a BOP 91 is utilized, after a testing tool is installed, the BOP is tested, and the testing tool is removed, a bowl protector (not shown) typically with a centralized a ring is installed within the respective bores drilling adapter 71, cementing adapter 51, and portions of the casing head 31. In the exemplary configuration, the bowl protector lands upon a shoulder 101 of the casing head 31 and can be secured in place at its upper end using the retaining pins/lock screws 79 of the drilling adapter 71.

Figure 5:
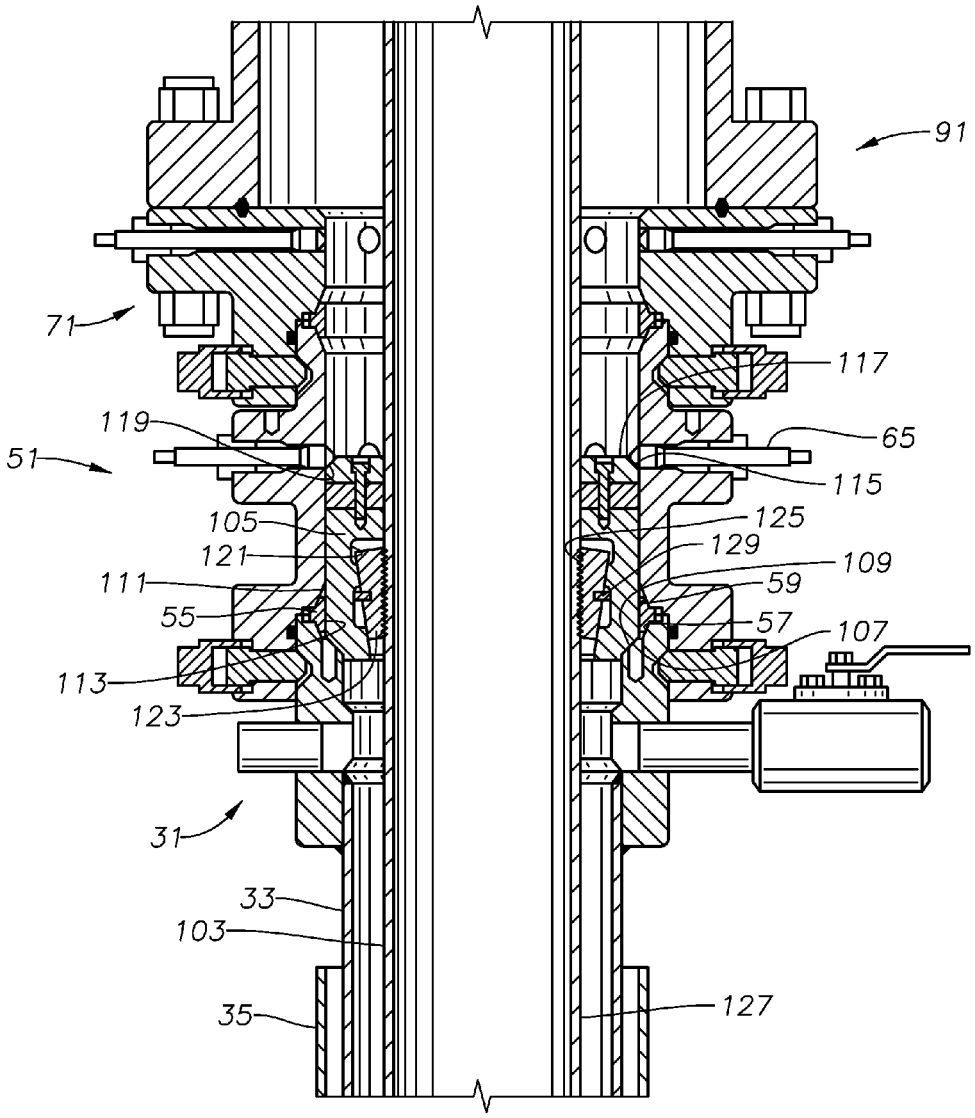
FIG. 5 is a partially perspective and partially cutaway view of a casing slips hanger supporting production casing positioned within a surface casing to retain cement back pressure according to an embodiment of the present invention.

Referring to FIG. 5, the rig (not shown) can then drill for production casing 103 (FIG. 5), the bowl protector can be removed, and production casing 103 and casing hanger 105 can be run. In an exemplary configuration, the production casing is 9⅝ inch casing run through the blowout preventer when a blowout preventer 91 is utilized, and wrapped around the outer surface of the production casing 103.

Note, the embodiment shown in FIGS. 3 and 4 include landing and fastening a quick disconnect drilling adapter 71 to the cementing adapter 51 and connection of a BOP 91. In embodiments where a BOP 91 is not required, the drilling adapter 71 can be removed along with the bowl protector prior to cementing, if desired.

Still referring to FIG. 5, according to the exemplary embodiment, a complementing annular arcuate surface 107 of the casing hanger 105 lands upon an annular shoulder 109 of the casing head 31, fixing the position of the lower end of the casing hanger 105. An outer surface 111 of the casing hanger 105 sealingly engages an inner surface 113 of the metal-to-metal seal 55 retained within the recess formed by the complementing tapered rims 57, 59, along the top of the casing head 31 and the bottom of the cementing adapter 51, respectively.

The retaining pins/lock screws 65 of the cementing adapter 51 are then run inward to engage an upper annular arcuate surface 115 of a cap 117 of the casing hanger 105 which is/are engaged by a complementing surface 119 of the retaining pins/lock screws 65 to retain the casing hanger 105 in an operational position primarily within the bore of the cementing adapter 51, and partially within upper portions of the casing head 31.

In the exemplary embodiment, the casing hanger 105 includes a recess 121 carrying a set of slips 123 having teeth or other high friction surface 125 for engaging an outer surface 127 of the production casing 103. A set of pins 129 or other fastening assembly as understood by those of ordinary skill in the art allow the gripping/high friction surface 125 of the slips 123 to orient within the recess 121 of the casing hanger 105 to conform to and frictionally engage the outer surface 127 of the production casing 103.

Figure 6:
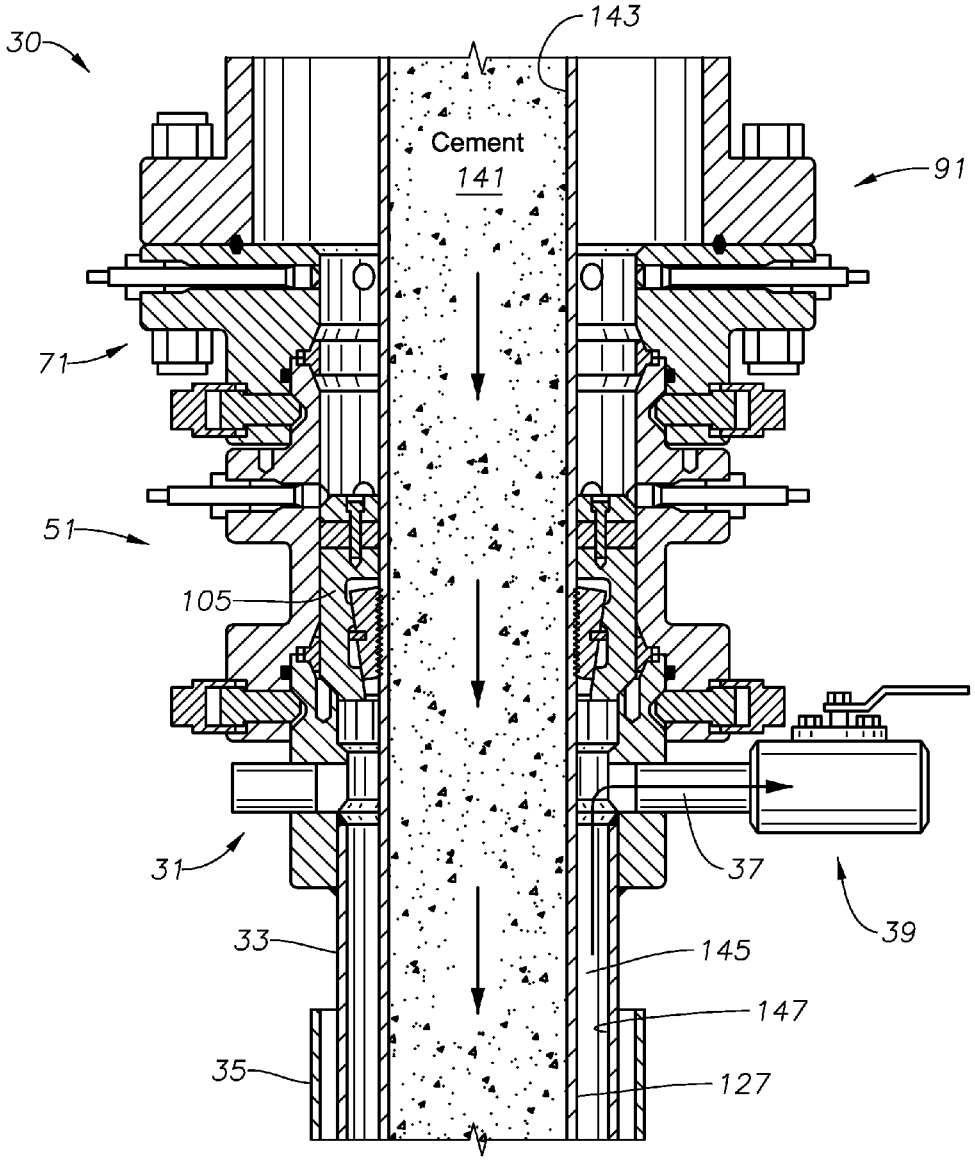
FIG. 6 is a partially perspective and partially cutaway view illustrating a cement pathway through the inner bore of the production casing, through the annulus between the production casing and surface casing, and through a cement return channel in the casing head according to an embodiment of the present invention.

Referring to FIG. 6, a typically foam-type cement 141 is pumped down through the inner bore 143 of the production casing 103 until and/or after the cement 141 exits the cement channel 37, through the cement return valve 39, and through a return line (not shown) typically extending to the rig. Exiting of the cement 141 without air gaps provides a positive indication that the annulus 145 between the outer surface 127 of the production casing 103 and the inner bore 147 of the surface casing 33.

Typically a plunger type-device provides the motivation for the cement 141 to travel down through the inner bore 143 of the production casing 103 until the end of the production casing 103 or an intermediate point, as desired, is reached.

According to the exemplary embodiments, beneficially, rather than waiting for the cement 141 to significantly solidify or otherwise bond, the BOP 91 and drilling adapter 71 (if a BOP 91 is employed) can be removed. Regardless of whether a BOP 91 is employed, the drilling adapter 71 can be removed after drilling is completed and prior to inserting the cement 141 into the bore 143 of the production casing 103, or afterward, but typically prior to substantial cement bonding. Beneficially, such expedient removal allows for reducing any unnecessary delay in retasking components no longer necessary to provide cement back pressure according to various embodiments of the present invention.

Figure 8:
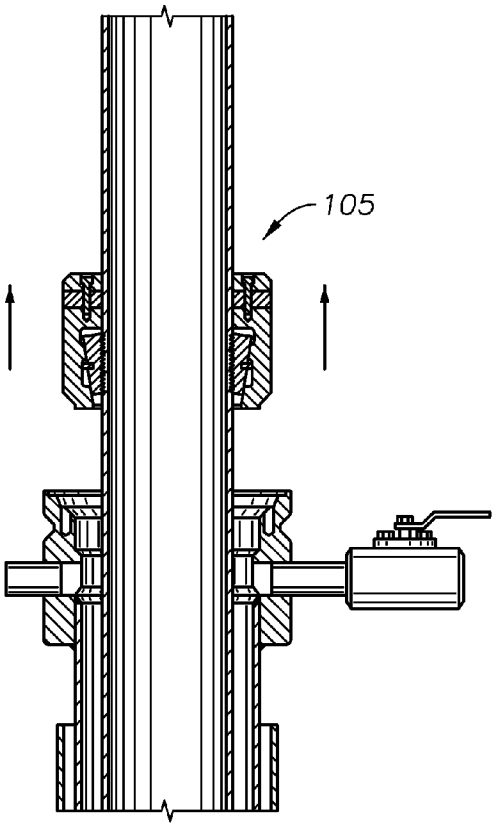
FIG. 8 is a partially perspective and partially cutaway view illustrating removal of the casing slips hanger to provide for retasking according to an embodiment of the present invention.
Figure 7:
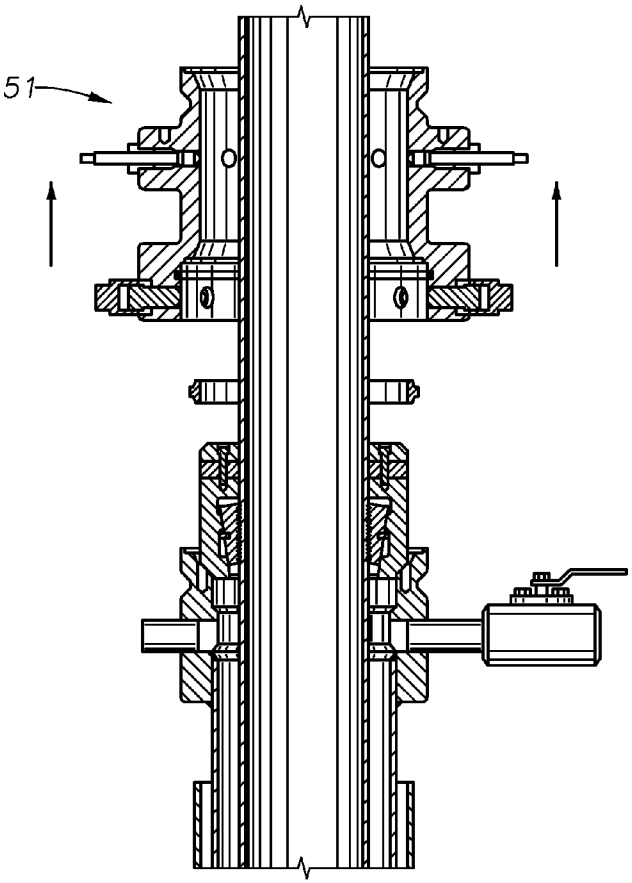
FIG. 7 is a partially perspective and partially cutaway view illustrating removal of the cementing adapter to provide for retasking according to an embodiment of the present invention.

Referring to FIGS. 7 and 8, again, regardless of whether or not a BOP 91 was employed, after the cement is substantially bonded and back pressure is no longer required, the cementing adapter 51 and the casing hanger 105 can be pulled and returned to operational duty.

The remaining steps and employment of apparatus 30 according to an exemplary embodiment include installation of a high temperature pack off, welding a tubing head to the production casing 103, installing another drilling adapter and BOP 91, testing the BOP 91, running a bowl protector, drilling for, e.g., a 7 inch liner, removing the bowl protector, running the liner, removing the drilling adapter and BOP 91, and readying the well for completion as understood by those of ordinary skill in the art. In an embodiment where the BOP 91 is employed, the modified casing head having a cement return valve 39 remains in place as part of a permanent well fixture.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

The invention claimed is:

1. A method of managing cementing operations with a drilling rig, the method comprising:

landing a casing hanger at least partially within a bore of a cementing adapter and in contact with a casing head connected to a surface casing, the casing hanger circumscribing outer surface portions of a production casing and positioned to retain back pressure of cement within an annulus located between the production casing and surface casing to thereby provide for removal of a drilling adapter initially positioned atop the cementing adapter prior to bonding of the cement;

cementing the production casing within the surface casing, the step of cementing including injecting cement into an annulus located between the production casing and the surface casing, and returning at least a portion of the cement through one or more cement return channels extending through the casing head;

re-tasking the drilling rig prior to substantial bonding of the cement; the method further comprising:

connecting the casing head atop the surface casing landed within a conductor pipe;

connecting a cementing adapter atop the casing head a quick connection;

connecting a drilling adapter atop the cementing adapter with a quick connection; and removing the drilling adapter prior to substantial bonding of the cement.

2. A method as defined in claim 1, further comprising the step of:

removing the cementing adapter and casing hanger after substantial bonding of the cement.

3. A method as defined in claim 1, wherein the casing hanger is a casing slips hanger landed atop the casing head, wherein the cementing adapter includes a lock on member configured to engage a shoulder on the casing hanger to immobilize the casing hanger in contact with the casing head.

4. A method as defined in claim 1, further comprising the steps of:

connecting a blowout preventer to the drilling adapter; and removing the blowout preventer prior to substantial bonding of the cement.

5. A method as defined in claim 1, wherein the cement is a foam type cement.

6. A method as defined in claim 1, wherein the surface casing is 13⅜ inch surface casing, and wherein the production casing is 9⅝ inch production casing.

7. A method of managing cementing operations, the method comprising:

connecting a casing head atop a surface casing landed within a conductor pipe, the casing head having at least one cement return channel extending therethrough;

connecting a cementing adapter atop the casing head with a quick connection;

connecting a drilling adapter atop the cementing adapter with a quick connection;

connecting a blowout preventer to the drilling adapter;

drilling for the insertion of production casing;

running the production casing;

providing a casing hanger with casing slips;

positioning the casing hanger atop the casing head and at least partially within a bore of the cementing adapter to be immobilized therein and circumscribing outer surface portions of the production casing, the casing hanger positioned to retain back pressure of cement within an annulus located between the production casing and the surface casing to thereby provide for removal of the drilling adapter and blowout preventer prior to bonding of the cement; and cementing the production casing within the surface casing, the step of cementing including injecting cement into the annulus and returning at least a portion of the cement through the casing head.

8. A method as defined in claim 7, wherein the cementing adapter includes a lock on member configured to engage a shoulder on the casing hanger to immobilize the casing hanger in contact with the casing head.

9. A method as defined in claim 7, wherein a drilling rig is tasked to run the production casing, the method further comprising the steps of:

removing the drilling adapter prior to substantial bonding of the cement; and removing the blowout preventer prior to substantial bonding of the cement.

10. A method as defined in claim 9, further comprising the step of:

re-tasking the drilling rig prior to substantial bonding of the cement.

11. A method as defined in claim 9, further comprising the steps of:

removing the cementing adapter and casing hanger for next use after substantial bonding of the cement.

12. An apparatus for managing cementing operations, the apparatus comprising:

a casing head connected to a surface casing landed within a conductor pipe, the casing head having at least one cement return channel to return cement therethrough;

a cementing adapter including a quick connection to connect to the casing head;

a drilling adapter at least initially positioned atop the cementing adapter;

production casing;

an annulus located between the production casing and the surface casing and in fluid communication with the cement return channel of the casing head; and a casing hanger that is a casing slips hanger positioned atop the casing head at least partially within a bore of the cementing adapter and immobilized therein, the casing hanger circumscribing outer surface portions of the production casing and configured to retain back pressure of cement within the annulus to thereby provide for removal of the drilling adapter prior to bonding of the cement.

13. An apparatus as defined in claim 12, wherein the cementing adapter includes a lock on member configured to engage a shoulder on the casing hanger to immobilize the casing hanger in contact with the casing head.

14. An apparatus for managing cementing operations, the apparatus comprising:

a casing head connected to a surface casing landed within a conductor pipe, the casing head having at least one cement return channel extending therethrough;

a cementing adapter including a quick connection to connect to the casing head;

a drilling adapter including a quick connection to the cementing adapter and at least initially positioned thereon and that is configured to be removed after cement is introduced into the cementing adapter but prior to bonding of the cement;

a blowout preventer to connect to the drilling adapter;

production casing;

cement positioned within an annulus located between the production casing and the surface casing, at least a portion of the cement flowing through the at least one cement return channel;

a casing hanger atop the casing head, the casing hanger circumscribing outer surface portions of the production casing and positioned at least partially within a bore of the cementing adapter and immobilized therein and configured to retain back pressure of cement within the annulus to thereby provide for removal of the drilling adapter and blowout preventer prior to bonding of the cement; and slips along an inner surface of the casing hanger that are selectively removable from the casing hanger and which have a profiled surface, so that when selectively moved to an axial location within the casing hanger, the slips wedge between the casing hanger and the production casing to couple together the casing hanger and production tubing.

15. An apparatus as defined in claim 14, wherein the cementing adapter includes a lock on member configured to engage a shoulder on the casing hanger to immobilize the casing hanger in contact with the casing head.

* * * * *